US005474266A

United States Patent [19]

Koglin

[11] Patent Number: 5,474,266

[45] Date of Patent: Dec. 12, 1995

[54] RAILROAD HIGHWAY CROSSING

[76] Inventor: Terry L. Koglin, 6 Colonial Ave., Princeton Junction, N.J. 08550

[21] Appl. No.: 76,776

[22] Filed: Jun. 15, 1993

[51] Int. Cl.[6] ..... B61L 29/00

[52] U.S. Cl. ..... 246/111; 246/113; 238/8

[58] Field of Search ..... 246/111, 114 A, 246/118, 120; 238/8, 3, 4, 5; 14/31, 36, 37, 38, 48

[56] References Cited

U.S. PATENT DOCUMENTS

| | | | |
|---|---|---|---|
| 1,412,327 | 4/1922 | Abt | 14/38 |
| 1,680,821 | 8/1928 | Strauss | 14/36 |
| 2,999,137 | 9/1961 | Prokopik | 14/36 |
| 4,004,765 | 1/1977 | Barlow | 246/118 |
| 4,169,296 | 10/1979 | Wipkink et al. | 14/35 |

*Primary Examiner*—Mark T. Le

[57] ABSTRACT

Sections of a highway crossing over the rail road are raised completely clear of the rail road to form a barrier preventing automobile traffic from entering the rail road when a train is at or nearing the crossing. When the train has passed, the barrier sections are lowered, reforming the grade crossing so that automobile traffic may cross the rail road at near grade. The ends of each barrier transverse to the centerline of the roadway are shaped and positioned so that a continuous surface is formed when the barrier sections are in the lowered position, partly resting on the rail road or nearby supports, allowing automobiles to continue over the rail road by means of driving on the upper surfaces of the lowered barriers, with only small gaps at the joints where the sections adjoin each other or meet the approach roadway.

5 Claims, 2 Drawing Sheets

RAILROAD HIGHWAY CROSSING

BACKGROUND OF THE INVENTION

1. Field of the Invention

This invention relates to railroad-highway grade crossings, separations, and protection devices, particularly a new and improved combination with barrier gates, and devices to assist in maintenance of railroad tracks.

2. Description of the Prior Art

Attempts to prevent the damaging and frequently fatal interaction of railroad and highway traffic at grade crossings have included simple warning signs, usually black and white "cross bucks" of various forms and inscriptions; flashing red lights in conjunction with these signs on busier roads; and vertically swinging arm gates which, in the lowered position, block at least part of the roadway on its side of the tracks upon approach of a train. Alternately, highway overpasses or underpasses are built, at great expense, to completely eliminate the intersection of railroad and highway traffic. Many patents have been issued on various types of and improvements to railroad crossings, including warning signals, retractible speed bumps, gates and barriers.

The other aspect of my invention lies in the field of maintainability of highway-railroad grade crossings. A vast number of patents have been issued in this area, spread out over time from before the advent of the automobile to the present. Almost all patents cited in this area relate to fixed crossings which were proposed to be more durable, or easier to install or repair, than previous types. All cited prior art in this category has in common the utilization of the railroad track rail head as a portion of the automobile's riding surface, in that the top of the rails and the automobile riding surface are essentially coplanar, with material specified in their patents forming the roadway surface between the rails of a track and in most cases also forming the roadway surface for a short distance to the outboard side of each track rail. All but a few of these prior inventions call for the crossing material to occupy a fixed position relative to the railroad tracks, so that the crossing planks or slabs remain in the same position when a train rolls along the track over them, and in the same position they carry an automobile as it crosses the tracks by riding upon the crossing in question. Some of the prior inventions call for sprung flangeways, to keep dirt out, or cushioning of the surface on which automobiles ride, or hinges at the sections between the track rails, so that sections be loosened and swung up and removed manually when necessary to perform limited maintenance work on the railroad tracks between the rails. The present invention separates the planes of automobile-roadway contact and railroad rolling stock wheel tread-rail head contact sufficiently to allow the two to be completely distinct; mechanically raising the road surface at the crossing to form a barrier to automobile traffic while allowing railroad traffic to proceed through the crossing, with the complete track structure exposed when the roadway is raised, allowing unimpeded maintenance work to be performed on the railroad tracks; and lowering the highway surface onto the railroad track to allow passage of highway vehicles over the crossing.

SUMMARY OF THE INVENTION

A railroad-highway crossing at near grade having a novel feature of mechanically movable components is disclosed in which the automobile roadway at the railroad track or tracks normally projects over the tracks, but is lifted out of the way each time a train approaches, or maintenance, repair or renewal work is to be done on the railway tracks at the crossing, and when lifted out of the way in such manner it forms a barrier preventing automobiles from entering onto the railroad right of way.

My disclosure will be found to be of special value for high speed rail lines, at which motorists presently find it tedious to wait while lights are flashing and warning gates are in the lowered position when they cannot see the train approaching, and try to pass around the gates, with unfortunate consequences. The disclosure is also pertinent to heavily used railroad lines, at which maintenance of track suffers at grade crossings because of inaccessibility, so that these locations are often the sites of broken rails or derailments. The disclosure will positively prevent motorists from crossing tracks in front of a train, and will easily provide full access to trackage for maintenance whenever it is desired.

DESCRIPTION OF THE PREFERRED EMBODIMENT

Figure 1:
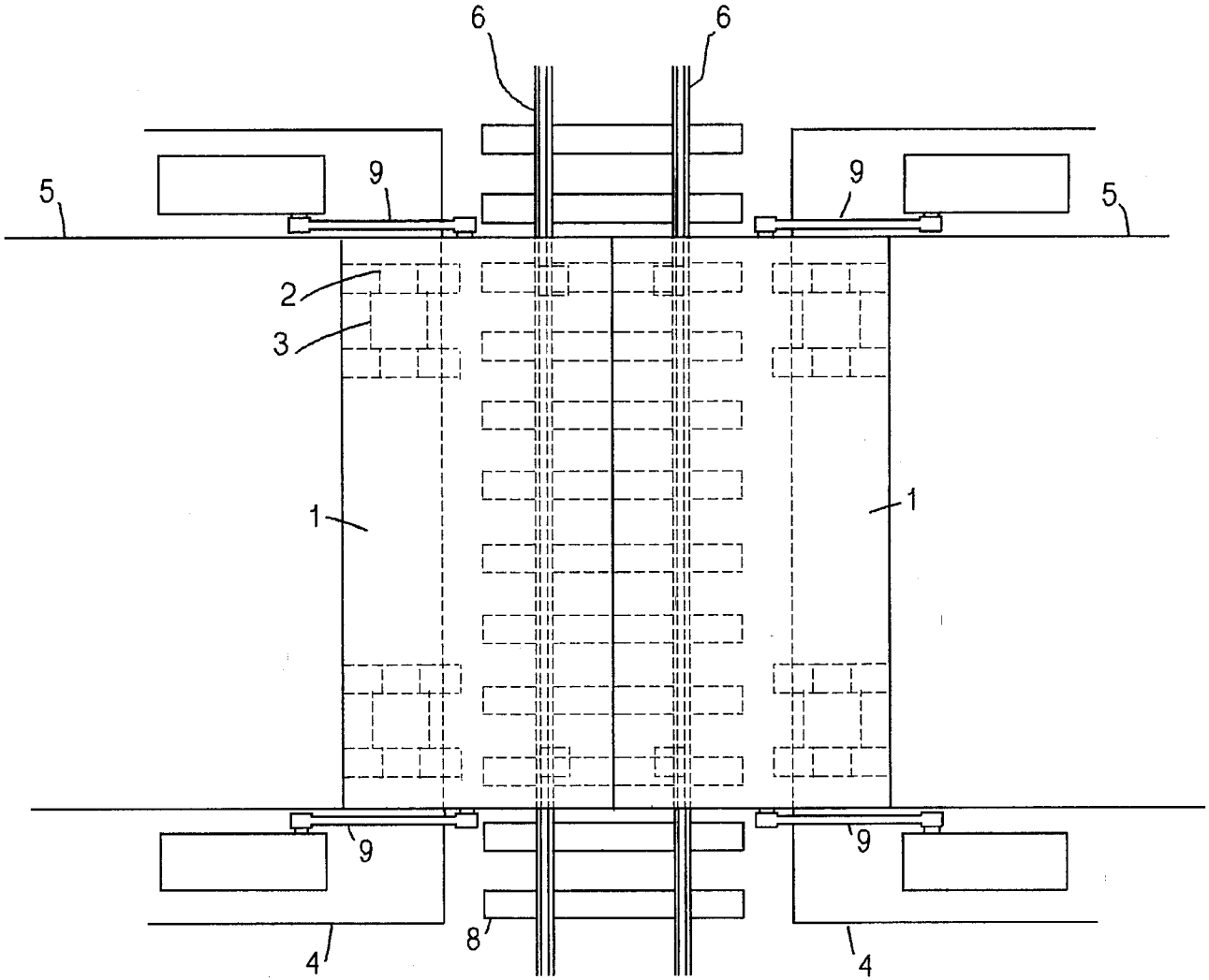
FIG. 1 is a plan view of the crossing.
Figure 2:
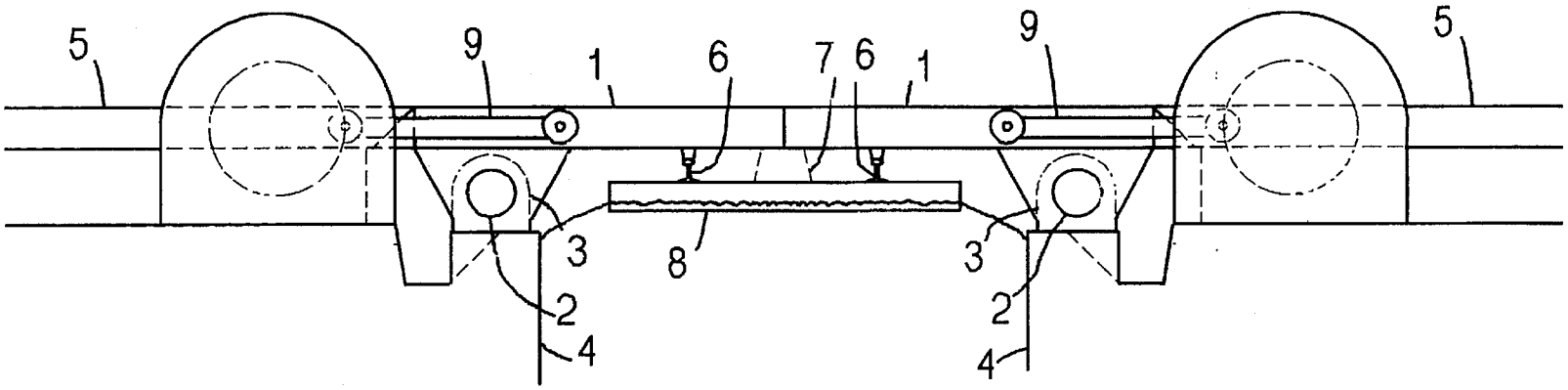
FIG. 2 is an elevation of the crossing, looking along the tracks.

By referring to the drawings and to FIG. 1 in particular it will be seen that the railroad highway grade crossing consists of moveable roadway elements (1) which are pivoted at the trunnions (2) which are mounted in bearings (3) supported on footings (4) adjacent to the approach roadways (5). The roadway elements over the tracks, when in the lowered position, are supported partially by the railway rails (6) or in cases where it is more convenient by pedestals (7) such as between a pair of railway tracks or fixed to the cross-ties (8). Rotation of the roadway elements to the vertical position, whence they become barriers to automobile traffic, is accomplished by the drive mechanisms and links (9) which can be motor driven via gears or use common hydraulic cylinders or linear actuators or other means commonly available. Actuation would preferably be automatic, as an approaching train closes a track circuit causing red lights to flash, then oncoming warning gates to lower, impeding traffic, then offgoing warning gates to lower, then, after sensors have assured that no traffic is stalled on the crossing, the barrier-roadway rotates up, blocking access to the tracks, and the train passes. When the train trips the departing track circuit, the barrier-roadway lowers again, the offgoing warning gates raise, then the oncoming warning gates raise, and the red lights are extinguished, and the crossing is again open to highway traffic. A remote camera could be installed so that the engineer of an approaching train or a dispatcher could view the crossing to make certain it is clear before raising the barrier.

OPERATION

The railroad highway crossing in its normal position is lowered, the roadway element extended ends resting on the tracks or on centrally located pedestals, while the rear ends are supported in the trunnion bearings, so that a firm, secure roadway is produced for automobile travel. If the railway tracks are equipped with a typical common ordinary track-circuit signalling system of the type generally in use the track circuit is then energized so that the railroad signals are displayed at stop for an approaching train. When a railway train does enter an approaching track circuit, however, with or without a railway signal system, the closing of that track circuit initiates operation of the barrier described in proper sequence with warning gates, bells, lights or other devices.

I claim:

1. A railroad and highway crossing system comprising:

at least one railroad having two rails and a longitudinal center line between said two rails, at least one highway crossing said railroad, said highway including a barricade system crossing said railroad, said barricade system including two sections, each said section having one end adjacent an end of the highway and pivotally mounted on a horizontal pivot, and having a second end terminated at the longitudinal center line of said railroad, said sections having a raised position to block highway traffic crossing the railroad, and a lowered position to allow highway traffic crossing the railroad, and each said section, in the lowered position, being supported at the second end directly on the rail.

2. A railroad and highway crossing system comprising:

at least one railroad having two rails and a longitudinal center line between said two rails, at least one highway crossing said railroad, said highway including a barricade system crossing said railroad, said barricade system including two sections, each said section having one end adjacent an end of the highway and pivotally mounted on a horizontal pivot, and having a second end terminated at the longitudinal center line of said railroad, said sections having a raised position to block highway traffic crossing the railroad, and a lowered position to allow highway traffic crossing the railroad, and each said section, in the lowered position, being supported at said second end directly on at least one support structure sitting on the longitudinal center line of the railroad.

3. The system according to any one of claims 1 and 2, wherein the horizontal pivot is a bearing.

4. The system according to any one of claims 1 and 2, wherein the support structure is a pedestal.

5. The system according to any one of claims 1 and 2, wherein automatic control means are provided to lower and raise the sections of the barricade system.

* * * * *